United States Patent [19]

Mickel

[11] Patent Number: 4,912,456

[45] Date of Patent: Mar. 27, 1990

[54] DOOR LATCH ALARM

[76] Inventor: Thattil J. Mickel, Thattil House P.O. Valapad-680567, Trichur (Dt), Kerala, India

[21] Appl. No.: 290,530

[22] Filed: Dec. 27, 1988

[51] Int. Cl.[4] ..... G08B 13/06

[52] U.S. Cl. ..... 340/542; 200/61.67; 200/61.93

[58] Field of Search ..... 340/542; 200/61.93, 200/61.64, 61.67

[56] References Cited

U.S. PATENT DOCUMENTS

| | | | |
|---|---|---|---|
| 3,866,203 | 2/1975 | Berns | 340/542 |
| 4,376,276 | 3/1983 | Barta | 340/545 |
| 4,465,997 | 8/1984 | Hines | 340/542 |
| 4,531,029 | 7/1985 | Trimble | 200/61.62 |
| 4,538,139 | 8/1985 | Clemente | 340/545 |
| 4,556,765 | 12/1985 | Shaw et al. | 200/61.71 |
| 4,575,713 | 3/1986 | Piper | 340/545 |
| 4,587,517 | 5/1986 | Engstrom et al. | 340/542 |
| 4,596,203 | 6/1986 | Lorek | 340/542 |
| 4,604,609 | 8/1986 | Wakefield, Jr. | 340/545 |

*Primary Examiner*—Glen R. Swann, III
*Attorney, Agent, or Firm*—Leon Gilden

[57] ABSTRACT

A housing is positionable within a door frame and includes an upper and lower compartment. The lower compartment includes a conventional dead-bolt latch with a secondary bolt operative by means of an associated handle. The secondary bolt includes an upwardly depending switch extending from the first compartment housing the dead-bolt and secondary bolt into the overlying second compartment housing circuitry operative to actuate an audible alarm response to the switch upon repositioning of the secondary bolt from an extended to a retracted position.

6 Claims, 1 Drawing Sheet

DOOR LATCH ALARM

BACKGROUND OF THE INVENTION

1. Field of the Invention

The instant invention relates to alarms, and more particularly pertains to a new and improved door alarm wherein the same is operative upon rotation of a handle associated with a latch mechanism of the door.

2. Description of the Prior Art

Prior art has included alarms of various types to be actuated upon unwarranted opening of a window or door within an associated framework. Prior art of the past has included structural organization of a relatively complex nature subject to failure or discouraging its implementation due to its complex organization. The instant invention attempts to overcome deficiencies of the prior art by setting forth a compact, yet effective organization t actuate an audible alarm upon unwarranted opening of a door within a framework.

Examples of prior art devices include Trimble U.S. Pat. No. 4,531,029 setting forth a switch mounted in a casing secured within a framework of the window or door closure wherein an opening through which a contact head protrudes, the contact head coupled frictionally to a sliding surface or the like associated with the stationary framework whereupon movement of the closure effects the contact head movable into position to actuate an associated micro-switch to trigger a remotely located alarm device. The patent requires cumbersome wiring and fails to provide a self-contained unit, as does the instant invention.

Clemente U.S. Pat. No. 4,538,139 sets forth a signaling apparatus for use in combination with a window or the like coupled to a remotely mounted receiver whereupon the signaling device includes an arm repositionable by a protuberance on the window to actuate the alarm.

Wakefield U.S. Pat. No. 4,604,609 sets forth a securement arrangement for a door including an elongate member connected between the door and an associated wall and a tautly mounted string joining a door knob of the door to an electrical switch on the wall wherein upon attempting to open the door, tension on the string effects actuation of a switch to thereby energize an associated alarm. The Wakefield patent is of a relatively cumbersome organization relative to the instant invention.

Shaw U.S. Pat. No. 4,556,765 to Shaw sets forth a contact unit for use with a door or window where a housing includes a first electrical conductive member and the fixing of the conductive member to the housing with an intermediate portion of the conductive member protruding through an opening of the housing whereupon the conductive member may be subject to flexure to effect a circuit to actuate an alarm. The invention is subject to relatively moving framework surfaces opposed to the instant invention operative upon manipulation of a handle associated with a door.

Piper U.S. Pat. No. 4,575,713 to Piper sets forth an alarm that may be mounted in a suspended manner from a door knob whereupon rotation of the door knob actuates the alarm by disturbing a pendulum type mounting within the alarm.

Engstrom U.S Pat. No. 4,587,617 to Engstrom sets forth a detection device for use with a door latch whereupon the detection device is operative upon the door being forced open without first retracting a bolt associated with a door to thereby cause a break in a conductive loop to actuate an associated alarm.

Hines U.S. Pat. No. 4,465,997 sets forth an alarm switch for indicating when a latch or dead-bolt for a door or window is locked or unlocked including a switch mounted on an exterior portion of the door operative with the dead-bolt to change position of a slide switch associated with a dead-bolt to engage or disengage from a contact assembly for indicating a locked or unlocked position of the door or window.

Barta U.S. Pat. No. 4,376,276 sets forth an alarm mechanism including an extending arm engageable upon repositioning of a door to contact the switch and actuate the associated alarm.

As such, it may be appreciated that the prior art fails to fulfill a need for a new and improved door alarm which addresses both the problems of compactness of storage, unitary construction, and effectiveness, and in this respect the present invention substantially fulfills this need.

SUMMARY OF THE INVENTION

In view of the foregoing disadvantages inherent in the known types of door alarms now present in the prior art, the present invention provides a door alarm wherein the same comprises a compact organization positionable within a door for effective audible indication of an unwarranted door opening. As such, the general purpose of the present invention, which will be described subsequently in greater detail, is to provide a new and improved door alarm which has all the advantages of the prior art door alarms and none of the disadvantages.

To attain this, the present invention comprises a housing including a lower first compartment and an upper second compartment wherein the first compartment includes a dead-bolt latch and a secondary bolt with the secondary bolt integrally formed with an orthogonally oriented first switch projecting through a slot communicating from the first to the second compartment. The first switch upon retraction of the secondary bolt completes an electrical circuit to actuate an audible alarm. A second switch is directed outwardly of the second compartment to deactivate the circuit.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved door alarm which has all the advantages of the prior art door alarms and none of the disadvantages.

It is another object of the present invention to provide a new and improved door alarm which may be easily and efficiently manufactured and marketed.

It is a further object of the present invention to provide a new and improved door alarm which is of a durable and reliable construction.

An even further object of the present invention is to provide a new and improved door alarm which is susceptible of a low cost of manufacture with reward to both materials and labor, and which accordingly is then susceptible of low prices of sale to the consuming public, thereby making such door alarms economically available to the buying public.

Still yet another object of the present invention is to provide a new and improved door alarm which provides in the apparatuses and methods of the prior art some of the advantages thereof, while simultaneously overcoming some of the disadvantages normally associated therewith.

Still another object of the present invention is to provide a new and improved door alarm wherein the same is set forth in a unitary housing for effective indication of an unwarranted door delatching.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set fort above will become apparent when consideration is given to the following detailed description thereof. Such description makes reference to the annexed drawings wherein.

DESCRIPTION OF THE PREFERRED EMBODIMENT

Figure 1:
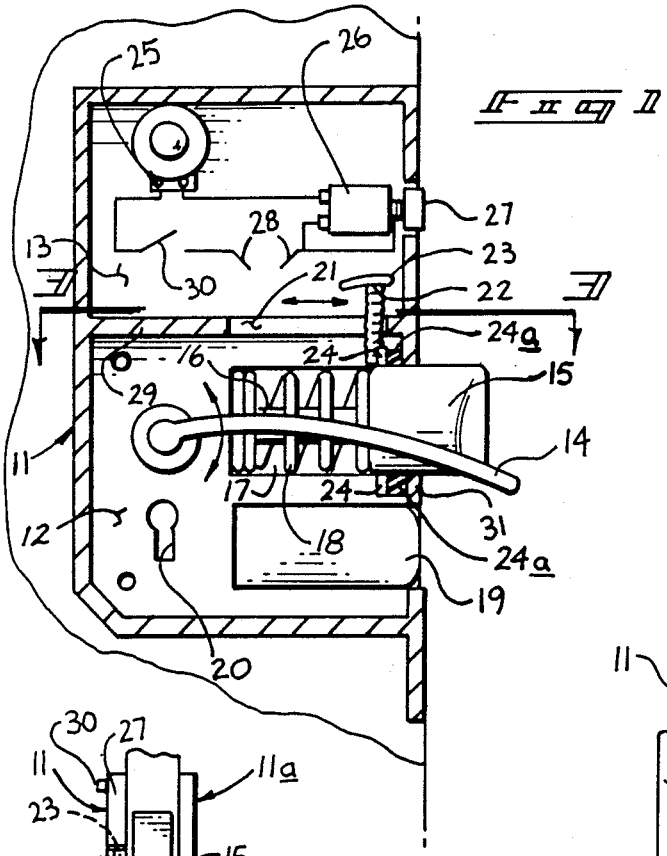
FIG. 1 is an orthographic view taken partially in section of the instant invention.

With reference now to the drawings, a new and improved door alarm embodying the principles and concepts of the present invention will be described.

More specifically, it will be noted that the door alarm apparatus essentially comprises a housing 11 fixedly secured to an interior surface of a door. A companion exterior housing 11a is secured to an external surface of the door is in alignment with the housing 11. The housing 11a rotatably supports an exterior handle 14a cooperating with interior handle 14 to actuate a reciprocatable latch bolt 15 in a conventional manner utilizing a reciprocatable bolt link 16 secured to the latch bolt 15 at a forward end and to an actuator rod 16a at a rearward end when the actuator rod 16a is operably secured to the aforenoted handles 14 and 14a.

The housing 11 includes a first lower compartment 12 and a second upper compartment 13, as illustrated in FIG. 1 for example. The lower compartment 12 secures the handle 14 therethrough and may further include a dead-bolt latch 19 reciprocatably actuated by a conventional key positionable through the associated key slot 20.

Figure 2:
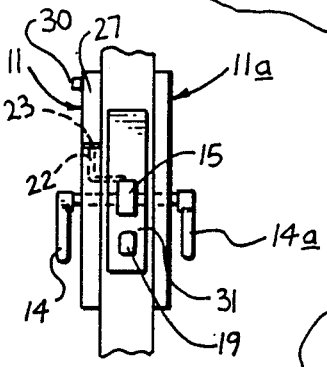
FIG. 2 is an orthographic end view of the instant invention.
Figure 3:
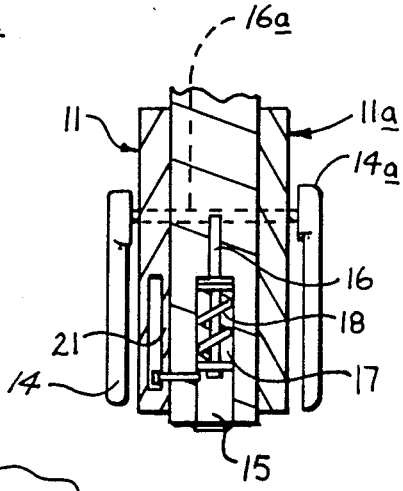
FIG. 3 is an orthographic view taken along the lines 3—3 of FIG. 1 in the direction indicated by the arrows.
Figure 4:
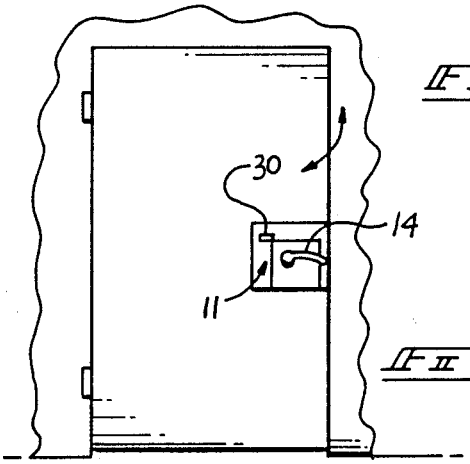
FIG. 4 is an orthographic view taken in elevation of the instant invention and an associated door.

The latch bolt 15 is maintained in a biased relationship by a latch bolt spring 18 positioned within the latch bolt cavity 17 housing the latch bolt 15. An intercommunicating elongate slot 21 is formed through an inner face wall 29 dividing the respective lower and upper compartments 12 and 13. An "L" shaped switch link 22 is reciprocatably mounted for movement within the slot 21 and is fixedly secured to a rearward upper surface of the latch bolt 15 at a forwardmost end of the horizontal leg of the "L" shaped link 22. The vertical leg of the "L" shaped link 22 is formed of a spring-like material to normally orient the vertical leg of the link 22 in a vertical orientation, but includes inherent flexibility to absorb shock and the like associated with door latch mechanisms. The horizontal leg of link 22 is of a relatively rigid material to align and maintain the link in orientation with the slot 21. Further to assist in the shock absorbing quality of the link mechanism, a plurality of diametrically opposed flanges 24 are fixedly secured exteriorly of the latch bolt 15 and are formed with impact absorbing polymeric buffer pads 24a in confronting relationship to a latch plate 31 associated with the latch bolt 15 and dead-bolt 19, as illustrated in FIG. 2, overlying a vertical surface of the door.

The "L" shaped link 22 is further formed with an orthogonally directed contact head 28 to effect electrical contact in an electrieal circuit, as will be noted below.

A bell alarm 25 is positioned within the upper compartment 13 and is powered by a DC battery source 26 replaceably mounted within the upper compartment 18 by means of a threaded battery access cover 27 threadedly formed into the upper compartment 13. A plurality of resilient contact fingers 28 depend downwardly from the associated electrical circuit, whereby upon rearward reciprocation of the latch bolt 15 and associated link 22, electrical communication is effected by completing the circuit through resilient contact fingers 28 to actuate the audible bell alarm 25. On/off slide switch 30 projecting outwardly of the housing 11, and more specifically the upper compartment 13, enables the circuit to be deactivated should the alarm mode not be desired whereupon the slide sWitch 30 is merely reciprocated rearwardly to open the circuit and accordingly may be slid forwardly to arm the circuit for actuation by the contact head 23.

The manner of usage and operation of the instant invention should be apparent from the above disclosure. Unauthorized entry by rotation of either interior handle 14 or exterior handle 14a will reciprocate the latch bolt 15 rearwardly whereupon the "L" shaped link 22 by way of the contact head 23 will complete the bell alarm circuit to actuate the audible bell alarm 25.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it Is not desired to limit the invention to the exact construction and operation shown and described, and accordingly, all suitable modifications and equivalents may be resorted to, falling within the scope of the invention.

What is claimed as being new and desired to be protected by Letters Patent of the U.S. is as follows:

1. A door alarm apparatus for use in combination with a pivotally mounted door comprising, a first housing mounted to an interior surface of said door, a second housing mounted to an exterior surface of said door aligned with said first housing, an interior handle rotatably mounted orthogonally through said first housing and aligned with and operatively associated with an exterior handle rotatably mounted orthogonally through said second housing, a latch bolt reciprocatably mounted in said door including a bolt link operatively associated with said interior and exterior handles to reciprocate said latch bolt from a first, forward, position exteriorly of said door to a second position interiorly of said door, a link means integrally secured to said latch bolt and extending into said first housing to actuate and audible alarm member when said latch bolt is in said second position, said audible alarm member being positioned within said first housing, and wherein said first housing comprises a first, lower, compartment including said interior handle and a second, upper, compartment and wherein said link means includes an "L" shaped link extending through an elongate slot formed within an inner face wall between said upper and lower compartments.

2. A door alarm apparatus as set forth in claim 1 wherein said "L" shaped link comprises a horizontal leg integrally secured to said latch bolt at one end and integrally secured to a vertical leg of said "L" shaped link at its other end wherein said horizontal leg is of a relatively rigid material and said vertical leg is of a relatively flexible material to absorb shock associated with said apparatus.

3. A door alarm apparatus as set forth in claim 2 wherein said "L" shaped link includes a contact head orthogonally formed to an upper end of said vertical leg whereby said contact head is operably mounted to complete an electrical circuit including a plurality of downwardly extending resilient fingers positioned to contact said contact head when said latch bolt is in said second position.

4. A door alarm apparatus as set forth in claim 3 wherein said electrical circuit includes a battery replaceably mounted within said upper compartment, and further including a threaded battery access cover threadedly mounted into said upper compartment to provide access to said battery.

5. A door alarm apparatus as set forth in claim 4 wherein said latch bolt further includes a plurality of diametrically opposed flanges wherein said flanges each include an impact absorbing buffer pad positioned between said flanges and a latch plate mounted to an exterior edge surface of said door to absorb impact of the latch bolt within said door when said latch bolt reciprocates from said second position to said first position.

6. A door alarm apparatus as set forth in claim 5 further including a slide switch mounted through said upper compartment to selectively activate or deactivate said electrical circuit.

* * * * *